US006653995B2

(12) United States Patent
Ho et al.

(10) Patent No.: US 6,653,995 B2
(45) Date of Patent: Nov. 25, 2003

(54) CONTROL METHOD APPLYING VOLTAGE ON PLASMA DISPLAY DEVICE AND PLASMA DISPLAY PANEL

(75) Inventors: Shirun Ho, Tokyo (JP); Keizo Suzuki, Kodaira (JP); Kenichi Yamamoto, Higashimurayama (JP); Norihiro Uemura, Kokubunji (JP)

(73) Assignee: Hitachi, Ltd., Tokyo (JP)

( * ) Notice: Subject to any disclaimer, the term of this patent is extended or adjusted under 35 U.S.C. 154(b) by 238 days.

(21) Appl. No.: 09/941,753

(22) Filed: Aug. 30, 2001

(65) Prior Publication Data

US 2002/0196209 A1 Dec. 26, 2002

(30) Foreign Application Priority Data

Jun. 26, 2001 (JP) ..... 2001-192618

(51) Int. Cl.[7] ..... G09G 3/28

(52) U.S. Cl. ..... 345/60; 345/67; 345/208; 315/169.4

(58) Field of Search ..... 345/60–63, 66–69, 345/208–210, 87–104; 315/169.4, 169.1, 169.3

(56) References Cited

U.S. PATENT DOCUMENTS 4,100,535 A * 7/1978 Bitzer et al. ..... 345/60

6,492,776 B2 * 12/2002 Rutherford ..... 345/60

FOREIGN PATENT DOCUMENTS

| | | |
|---|---|---|
| JP | 03-187125 | 8/1991 |
| JP | 07-262930 | 10/1995 |
| JP | 09-022772 | 1/1996 |
| JP | 08-315735 | 11/1996 |
| JP | 11-352927 | 12/1999 |

* cited by examiner

*Primary Examiner*—Lun-Yi Lao
(74) *Attorney, Agent, or Firm*—Mattingly, Stanger & Malur, P.C.

(57) ABSTRACT

The plasma display device includes a plasma display panel 101 having a plurality of discharge cells each having a pair of sustained discharge electrodes 102 and 103 and an address electrode 104. A voltage is applied to at least one of the sustained discharge electrodes and the address electrode in a sustained discharge period. A sustained discharge voltage is repeatedly applied to the sustained discharge electrodes 102 and 103. The sustained discharge voltage has a voltage waveform with a rise period (Tr) from a first voltage level to a second voltage level, a sustained period (Tsus) for maintaining the second voltage level, a fall period (Tf) from the second voltage level to the first voltage level and a sustained period (Tg) for maintaining the first voltage level.

12 Claims, 12 Drawing Sheets

FIG. 3

| CONTROL METHOD OF APPLYING VOLTAGE \ CHARACTERISTICS | | BRIGHTNESS (μJ) | JOULE CONSUMPTION (μJ) | ULTRA-VIOLET EMISSION EFFICIENCY (%) |
|---|---|---|---|---|
| CONVENTIONAL RECTANGULAR WAVEFORM | | 27.3 | 246 | 11.1 |
| NEW APPLIED VOLTAGE WAVEFORM | (A) | 28.0 | 229 | 12.2 |
| | (B) | 56.3 | 478 | 11.8 |
| | (C) | 33.7 | 276 | 12.2 |
| | (D) | 52.2 | 436 | 12.0 |
| | (E) | 102 | 825 | 12.3 |

CONTROL METHOD APPLYING VOLTAGE ON PLASMA DISPLAY DEVICE AND PLASMA DISPLAY PANEL

BACKGROUND OF THE INVENTION

The present invention relates to a plasma display device comprising a plasma display panel (hereinafter abbreviated to "PDP") and a control method of applying voltage on the plasma display device.

A plasma display device comprising a PDP has recently been developed as a low-profile large screen color display device.

An AC planar plasma display panel with three electrodes shown in FIG. 10 is widely developed at present. In the AC planar plasma display panel with three-electrodes, a pair of glass substrates, i.e., a front panel 1001 and a back panel 1008 are provided to be opposed to each other with forming a discharge region 1013 therebetween. The discharge region 1013 is filled with a mixture gas, that is used as a discharge gas, composed of He, Ne, Xe, Ar and the like at a pressure not less than several hundreds of Torrs. At the bottom surface of the front panel 1001 provided at the side of a display surface, there is formed a pair of sustain discharge electrodes comprising X electrodes and Y electrodes placed in parallel to each other. A voltage is applied repeatedly to the pair of sustain discharge electrodes to cause a continuous emission. Generally, the X electrodes and the Y electrodes respectively are composed of transparent electrodes and opaque electrodes for supplementing a conductivity of the transparent electrodes. In other words, the X electrodes are composed of transparent X electrodes such as 1002-1 and 1002-2 and opaque bus X electrodes such as 1004-1 and 1004-2, while the Y electrodes comprises transparent Y electrodes such as 1003-1 and 1003-2 and opaque bus Y electrodes such as 1005-1 and 1005-2.

Each of the sustain discharge electrodes is coated with a front dielectric layer 1006, and a thin protection layer 1007 of magnesium oxide (MgO) or the like is formed on the front dielectric layer. MgO is high in secondary electron emission and serves to intensify a discharge at a collision with ions such as He, Ne, Xe and Ar that are generated by the discharge, thereby lowering a starting voltage. Further, MgO is excellent in sputtering resistance and, therefore, serves to protect the front dielectric layer 1006 from damages otherwise caused by a direct collision of the ions such as He, Ne, Xe and Ar generated by the discharge with the front dielectric layer 1006.

In turn, on upper surface of the back panel 1008, there are provided electrodes to write data for address discharge, or, address electrodes (hereinafter simply referred to as "A electrodes") 1009 in an orthogonal direction with respect to the sustain discharge electrodes. Each of the A electrodes 1009 is coated with a back dielectric layer 1010, and ribs 1011 are provided on the back dielectric layer 1010 in such a manner as to sandwich the A electrodes 1009. Phosphors 1012 are applied on concaved regions, respectively, each of which is formed by wall surfaces of the ribs 1011 and an upper surface of the back dielectric layer 1010.

In above configuration, an intersection of the pair of sustain discharge electrodes and the A electrodes corresponds to a discharge cell region, and discharge cells are arranged in a matrix of about 1000×10000 in two dimensions. In the case of a color display, a pixel is composed of a three kinds of discharge cells respectively coated with red, green and blue phosphors.

An operation of a PDP will be described below.

A principle of emission of a PDP is such that a plasma comprising electrons and ions is generated from a discharge gas by means of a voltage applied to X and Y electrodes, and the electrons cause the discharge gas in a ground state to be in an excitation state, followed by converting ultraviolet rays generated from the discharge gas in the excitation state into visible rays by means of phosphors.

As shown in a block diagram of FIG. 11, the PDP 1100 is incorporated into the plasma display device 1102. A signal generator of pictures 1103 sends a signal indicating a display screen to a driving circuit 1101. The driving circuit 1101 receives and converts the signal into a voltage to be supplied to each of electrodes of the PDP 1100.

FIG. 12(A) explains a time chart of a voltage applied during a TV field period that is required for displaying an image on the PDP shown in FIG. 11. As shown in (I) in FIG. 12(A), a single TV field period 1200 is divided into subfields 1201 to 1208 that are different in a number of sustain voltage pulse application. Gradation is represented by adjusting the number of sustain voltage pulse application of each of the subfields, i.e., an intensity of emission caused by the sustain discharge. In the case of using 8 subfields each having a weight corresponding to an intensity of emission based on a binary scale, a discharge cell for tricolor display is capable of $2^8$ (=256) gradations of brightness display, thereby making it possible to display about 16780000 colors. Each of the subfields has a period of reset discharge 1209 for restoring the discharge cell into an initial state, a period of address discharge 1210 for selecting an illuminated discharge cell and a period of sustain discharge 1211 for performing an emission display as shown in (II) of FIG. 12(A).

FIG. 12(B) shows applied voltage waveforms to be applied to the A, X and Y electrodes during the address discharge period 1210. The waveform 1212 is a voltage waveform applied to one of the A electrodes 1009 during the address discharge period 1210; 1213 and 1214 are voltage waveforms applied to i-th electrode and (i+1)th electrode of the Y electrodes; and the waveform 1217 is a voltage waveform applied to one of the X electrodes. Here, the applied voltages are respectively, V0, V21, V21 and V1 (V).

As shown in FIG. 12(B), in the case where a scan pulse 1215 is applied to i-th line of the Y electrodes, a discharge occurs between the Y electrodes and the A electrodes in a cell positioned at an intersection of the i-th line of the Y electrodes and the A electrodes 1009 of the voltage V0, and the discharge transfers from the Y electrodes to X electrodes to generate an address discharge. Such address discharge does not occur in a cell positioned at an intersection of the i-th line of the Y electrodes and the A electrodes 1009 to which the voltage V0 is not applied. The same applies to the case where a scan pulse 1216 is applied to the (i+1)th line of the Y electrodes. The cell at which the address discharge occurred, an electric charge generated by the discharge is formed as a wall charge on surfaces of the dielectric layer and the protection layer 1007 covering the X and Y electrodes, and a wall voltage Vw (V) occurs between the X electrodes and the Y electrodes. Presence or absence of a sustain discharge during the subsequent sustain discharge period 1211 hinges upon the presence or absence of the wall voltage.

FIG. 13(A) shows voltages waveforms applied simultaneously during the sustain discharge period 1211 of FIG. 12(A) between the X electrodes and the Y electrodes that are sustain discharge electrodes. An applied voltage waveform 1301 that is a voltage having a rectangular waveform is applied repeatedly to the Y electrodes and an applied voltage waveform 1302 that is a voltage having a rectangular waveform is applied repeatedly to the X electrodes. Each of the rectangular waveform serves to increase the voltage from 0 V to Vsus (V) in a rise period of a time 0<T<Tr (s) when a time of a head of the waveform is 0. During a time Tr<T<Tr+Tsus (s), the voltage Vsus (V) is maintained. During a time Tr+Tsus<T<Tr+Tf+Tsus (s), the voltage Vsus (V) is lowered to 0V. During a time Tr+Tf+Tsus<T<Tr+Tf+Tsus+Tg (s), the voltage 0V is maintained.

In turn, in the A electrodes, a constant voltage Va (V) of an applied voltage waveform 1303 is applied from a time 0. The period of the time 0<T<Tr+Tf+Tsus+Tg (s) becomes a cycle for a sustain discharge driving voltage, and the voltage of the rectangular waveform is applied alternately to the Y electrodes and the X electrodes.

The voltage value of the Vsus is so set that the absence or presence of the sustain discharge hinges upon the presence or absence of the wall voltage Vw that is a relative potential difference between the Y electrodes and the X electrodes caused by the address discharge. At the discharge cell where the address discharge occurs, it is so set that a sum of the wall voltage Vw and the sustain discharge voltage Vsus is larger than the starting voltage. In turn, at the discharge cell where the address discharge does not occur, it is so set that the sustain discharge voltage Vsus is lower than the starting voltage.

When one cycle of the sustain discharge driving voltage is finished, the relative potentials of the Y electrodes and the X electrodes are reversed to each other at the discharge where the address discharge occurred. When a second cycle of the sustain discharge driving voltage is applied between the sustain electrodes, the sum of the wall voltage Vw and the sustain discharge voltage Vsus exceeds the starting voltage again to repeat the discharge. Thus, a light emission continues for a period of time equivalent to the period of applying the sustain discharge driving voltage at the discharge cell whereat caused the address discharge, while no light emission occurs at a discharge cell where no address discharge is caused.

A emission efficiency of a presently available PDP is inferior to that of a cathode-ray tube, and it is necessary to improve the emission efficiency for the prevalence of a PDP as a home appliance. In the case of making a larger PDP, there is a problem that an electric power consumption increases with the increase in an electric current supplied to electrodes. To solve above problems, it is necessary to realize a PDP that achieves a high brightness with a lowered supply of electric current, thereby to improve the emission efficiency.

As techniques for improving the emission efficiency, an improvement in cell structure is proposed. For example, Japanese Patent Application Laid-open Nos. H8-315735, H8-22772 and H3-187125 propose a modification of a size or a form of a sustain discharge electrode. Japanese Patent Application Laid-open Nos. H8-315734 and H7-262930 propose a modification of a material of a dielectric that covers a sustain discharge electrode. Japanese Patent Application Laid-open No. H11-352927 proposes a modification of driving method, namely, a modification of a rectangular waveform into a driving waveform that is similar to an overshoot. Some of above techniques are put into practice; however, they do not reach the emission efficiency of the cathode-ray tube. In the improvement in the emission efficiency, it is especially difficult to improve an emission efficiency of ultraviolet rays and, therefore, the improvement is considered necessary as a break-through technique for developing the PDP as a home appliance.

SUMMARY OF THE INVENTION

The present invention is accomplished considering the above-described problems in the art, and an object of the present invention is to provide a plasma display device comprising a plasma display panel and a control method of applying a voltage on the plasma display device wherein the emission efficiency of ultraviolet rays is improved.

In order to achieve above object, the present invention provides a control method of applying a voltage on a plasma display device that displays an image by: structuring a discharge cell between a pair of a first electrode (Y or X electrode) and a second electrode (Y or X electrode) that is arranged in parallel to each other on a front panel and an address electrode to write data provided on a back panel; applying a sustain discharge voltage to each of the first and the second electrodes; and causing a discharge emission in the discharge cell to thereby display an image; wherein a discharge peak time of the discharge current is controlled by setting a voltage applied to the first and the second electrodes during a sustain discharge period to be a composite voltage which is a sum of the sustain discharge voltage and a variation voltage having a voltage larger than the sustain discharge voltage.

Further, the control method of applying a voltage on a plasma display device of the present invention comprises controlling the voltage applied to the address electrode in the sustain discharge electrode period to be a constant voltage or a voltage that is a sum of the constant voltage and a variation voltage. Further, the control method of applying a voltage on a plasma display device of the present invention comprises controlling the composite voltage to be a voltage having a waveform composed of an overshoot that is higher than the sustain discharge voltage and an over-dumping that is lower than the sustain discharge voltage.

Further, the present invention provides a plasma display device comprising a plasma display panel provided with a plurality of discharge cells in the form of a matrix each having a pair of a first electrode and a second electrode that are arranged in parallel to each other on a front panel and an address electrode to write data arranged on a back panel, a first driving circuit for applying a sustain discharge voltage to the first electrode, a second driving circuit for applying a sustain discharge voltage to the second electrode, a driving circuit to write data for applying a voltage to the address electrode, and a first variation voltage waveform generating circuit for adding a variation voltage to the sustain discharge voltage that is connected to each of the first and second driving circuits; wherein a composite voltage which is a sum of the sustain discharge voltage and the variation voltage is applied to each of the first and second electrodes.

The plasma display device according to the present invention comprises controlling the voltage applied from the driving circuit to write data to the address electrode to be a constant voltage or including a second variation voltage waveform generating circuit for adding the variation voltage to the constant voltage that is to be applied to the address electrode.

The plasma display device according to the present invention comprises an inductance circuit for controlling the composite voltage to be a voltage having a waveform composed of an overshoot that is higher than the sustain discharge voltage and an over-dumping that is lower than the sustain discharge voltage.

Further, the present invention provides a control method of applying a voltage on a plasma display device, comprising a plasma display panel having a plurality of discharge cells each comprising a pair of sustain discharge electrodes and an address electrode to write data for applying a voltage to at least one of the pair of sustain discharge electrodes and the address electrode during a sustain discharge period, the method comprising the steps of: applying to at least one of the pair of sustain discharge electrodes a sustain discharge voltage of a voltage waveform composed of a rise period (Tr) from a first voltage level to a second voltage level, a sustain period (Tsus) for maintaining the second voltage level, a fall period (Tf) from the second voltage level to the first voltage level and a sustain period (Tg) for maintaining the first voltage level, applying a constant voltage to the address electrode and applying to at least one of the pair of sustain discharge electrodes a composite voltage which is a sum of the sustain discharge voltage and a variation voltage during the rise period. Further, the control method of applying a voltage on a plasma display device of the present invention comprises controlling a main discharge peak time of a discharge current by controlling the composite voltage to be generated during the rise period and changing a time period during which the discharge voltage larger than the sustain discharge voltage is generated.

Further, the control method of applying a voltage on a plasma display device of the present invention comprises applying to the address electrode a voltage to which the variation voltage during a period where a time (T) is $Tr+Tf+Tsus<T<Tr+Tf+Tsus+Tg$ is added.

BRIEF DESCRIPTION OF THE DRAWINGS

FIG. 3 shows a discharge and emission characteristics of the plasma display panel according to a control method of applying voltage of the present invention, which is compared to that of a conventional control method of applying voltage;

DETAILED DESCRIPTION OF THE PREFERRED EMBODIMENTS

Figure 1:
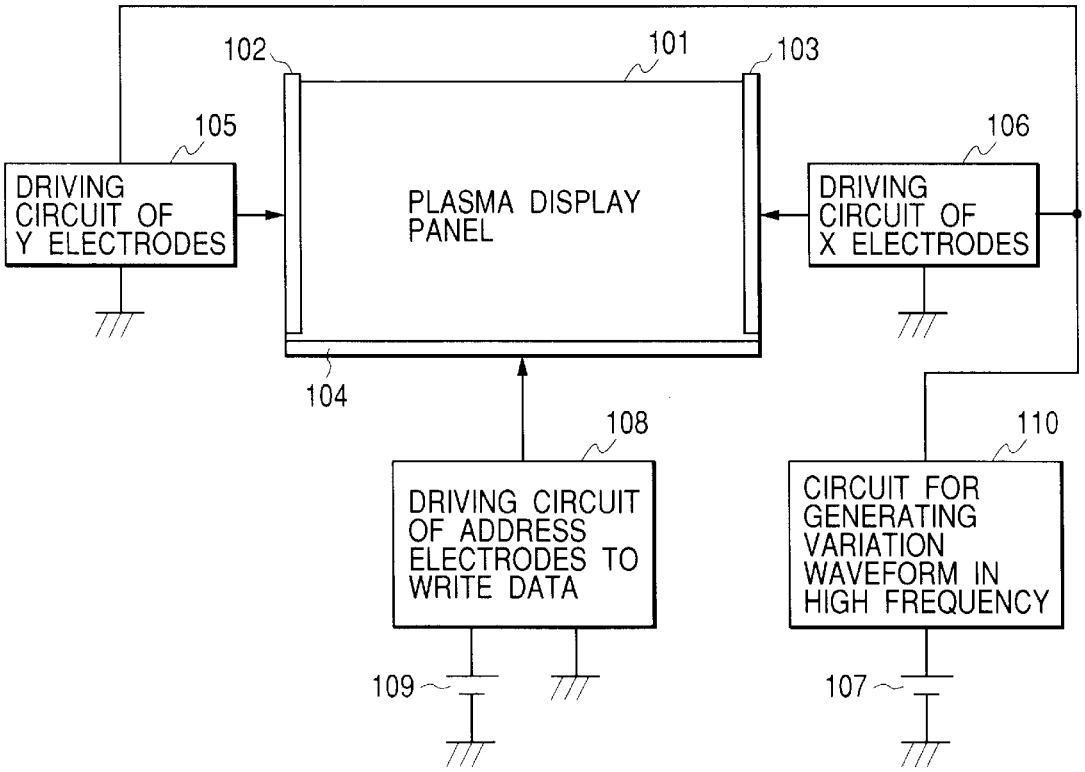
FIG. 1 is a schematic block diagram of plasma display device according to a first embodiment of the present invention.

Embodiments of the present invention will hereinafter be described in detail with reference to the attached drawings. In addition, in the drawings for illustrating modes of embodiments, an identical reference numeral is given to components having an identical function and repetitive explanation is omitted.

Embodiment 1

FIG. 1 is a schematic block diagram of a plasma display device according to the first embodiment of the present invention.

As shown in FIG. 1, the plasma display device of the present invention comprises a PDP 101, an electrode terminal of Y 102, an electrode terminal of X 103, an electrode terminal of A 104, a driving circuit of Y electrodes 105 for driving the electrode terminal of Y, a driving circuit of X electrodes 106 for driving the electrode terminal of X, a power source 107 for applying a voltage to the driving circuits for X and Y electrodes, a driving circuit of A electrodes 108, a power source 109 for applying a voltage to the driving circuit of A electrodes and a circuit for generating variation waveform in high frequency 110 that is connected in series to a power source for applying a voltage and power to the driving circuit.

Figure 2A:
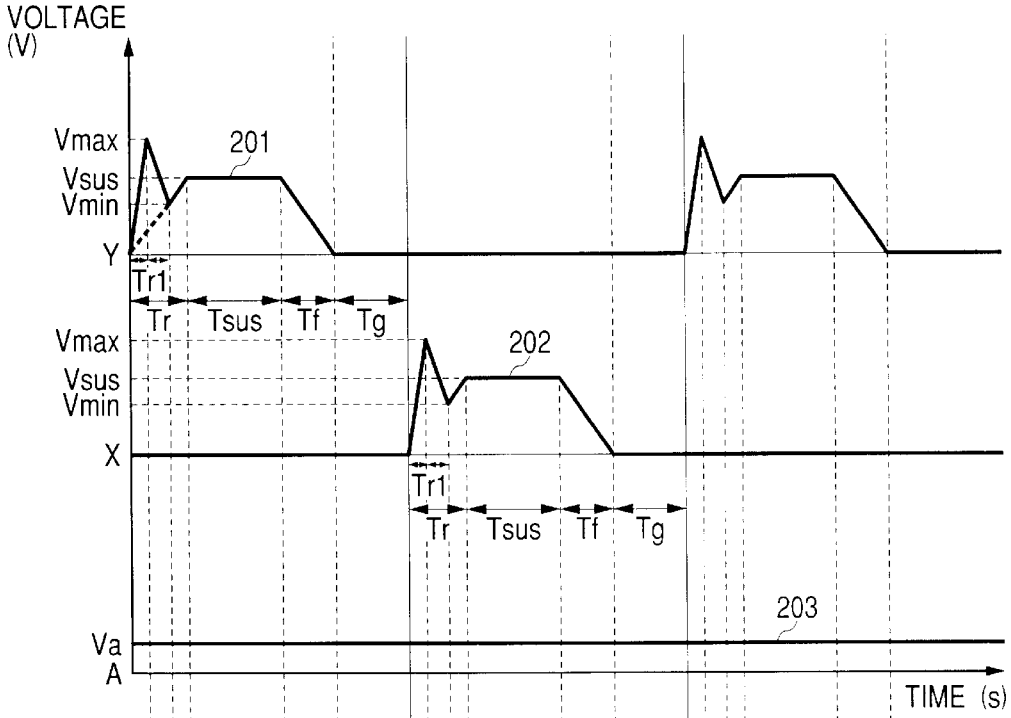
FIGS. 2(A) and 2(B) show an applied voltage sequence and a discharge current waveform of a plasma display panel of the plasma display device according to the first embodiment of the present invention.
Figure 2B:
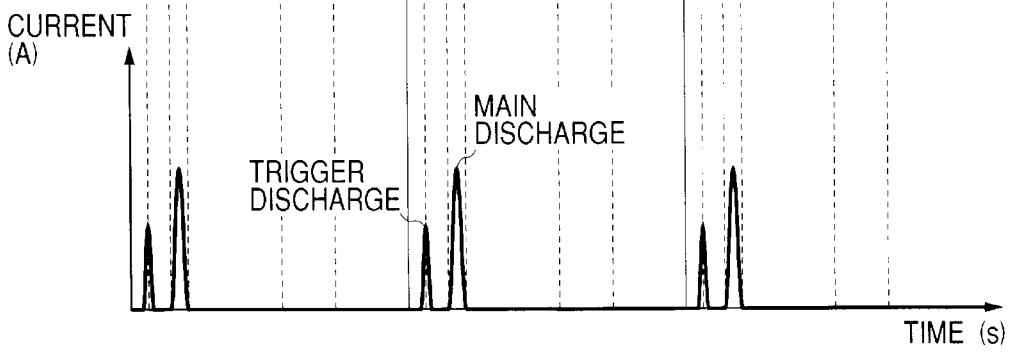

FIG. 2(A) shows an applied voltage sequence of the PDP of the plasma display device according to the first embodiment of the present invention. FIG. 2(B) shows a discharge current waveform.

The discharge period has, similarly to that shown in the drawing of the conventional art, at least an address discharge period to write data 1200 for selecting a discharge cell to discharge and emit light and a sustain discharge period 1201 for causing a discharge emission by repeatedly applying a pulse voltage to the X electrodes and the Y electrodes. In the address discharge period to write data, a wall voltage Vw (V) is generated between the X and Y electrodes of a discharge cell to cause the discharge emission during the sustain voltage period in the same manner as that in the art. A voltage that is appropriate for causing a discharge between the X electrodes and the Y electrodes as well as between these electrodes and the A electrodes only when there is the wall voltage is applied between the X electrodes and the Y electrodes as well as between these electrodes and the A electrodes, so that only a desired discharge cell discharges and emits light. Thus, the discharge cells are sorted into those emit light during the sustain discharge period and those do not emit light during the sustain discharge period.

Figure 12A:
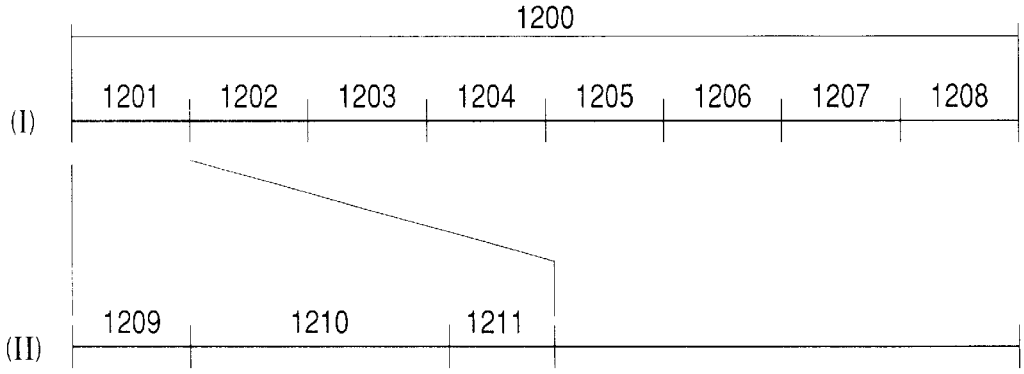
FIGS. 12(A) and 12(B) illustrate an operation of a driving circuit during one TV field that displays an image on a plasma display panel of a plasma display device.
Figure 12B:
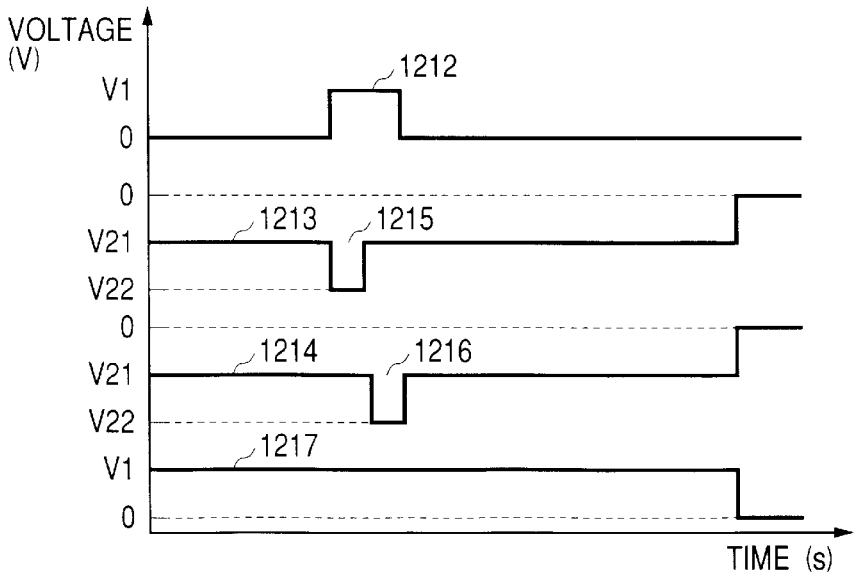
Figure 13A:
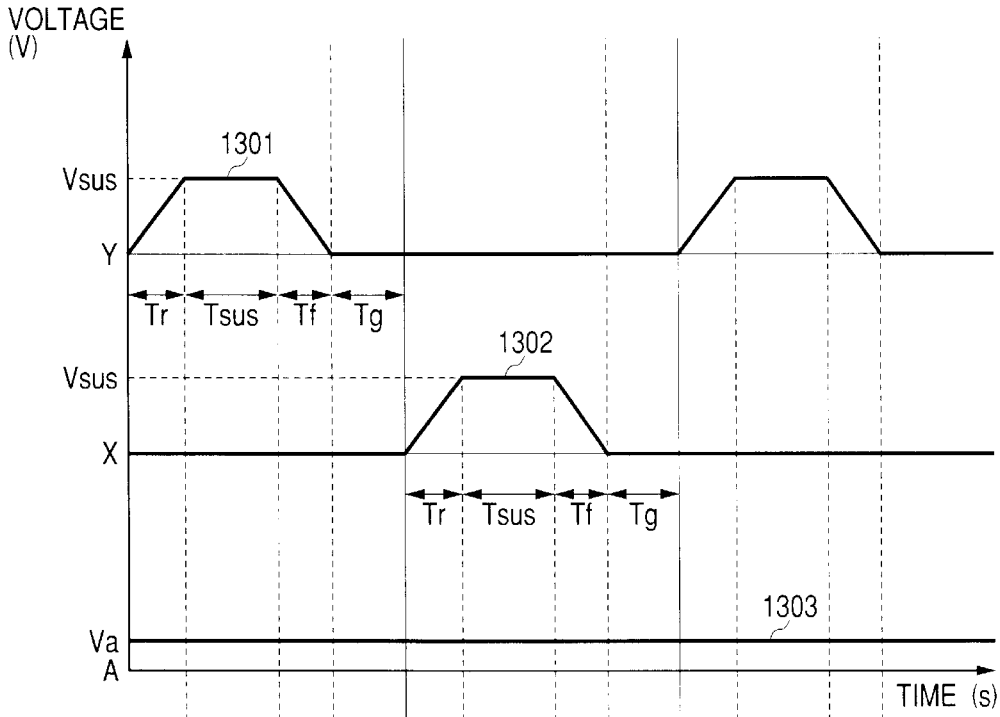
FIGS. 13(A) and 13(B) show a conventional applied voltage sequence and a conventional discharge current waveform of a plasma display panel of a plasma display device.
Figure 13B:
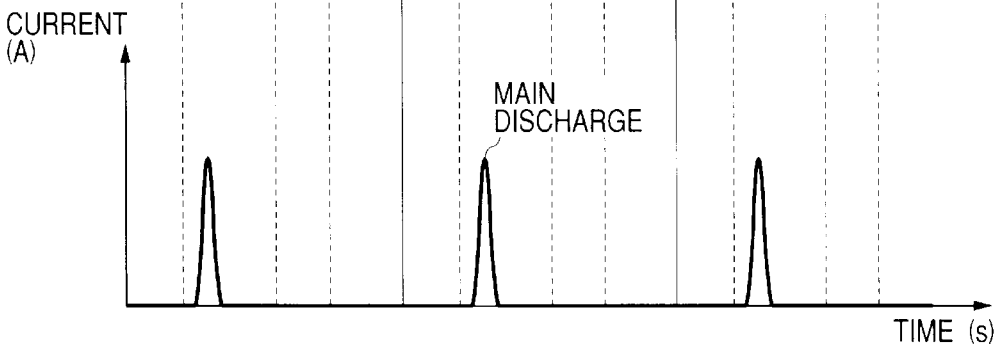

Shown in FIG. 2(A) is voltage waveforms of the sustain discharge voltages applied simultaneously between the X electrodes and the Y electrodes during the sustain discharge period 1211 shown in FIG. 12(A). A composite voltage waveform is applied to the Y electrodes and the X electrodes that are sustain discharge electrodes in such a manner that a voltage applied from a circuit for generating variation waveform in high frequency 110 is overlapped with a conventional rectangular waveform that is applied repeatedly. The composite voltage waveform is formed into a voltage waveform 201 at a side of the Y electrodes and is formed into a voltage waveform 202 at a side of the X electrodes.

When the head of each of the composite voltage waveforms is a time 0, each of the composite voltages has a voltage waveform that reaches to a maximum voltage (or a peak voltage) Vmax (V) by a first rise at a time 0<T<Tr1 (s), followed by reaching to a minimum voltage Vmin (V) by a first fall at a time Tr1<T<2Tr1 (s) and then leads to a rise of the conventional rectangular waveform at a time 2Tr1<T<Tr (s).

At a time Tr<T<Tr+Tsus (s), a constant voltage value Vsus (V) is applied, followed by lowering the voltage to 0V by a second fall at a time Tr+Tsus<T<Tr+Tf+Tsus (s), and then the voltage 0V is maintained at a time Tr+Tf+Tsus<T<Tr+Tf+Tsus+Tg (s). The composite voltage waveform is applied alternately to the Y electrodes and the X electrodes. A constant voltage Va is applied to the A electrodes in the same manner as the conventional art to form an applied voltage waveform 203.

A discharge current waveform in the sustain discharge period is shown in FIG. 2(B). A peak time of a main discharge current is set at a time 2Tr1<T<Tr (s) in a second rise voltage period by shortening a time Tr1, followed by increasing a sustain voltage at a time T=Tr1 to Vmax (V) that is equivalent to or higher than Vsus (V), and then decreasing a sustain voltage at a time T=2Tr1 (s) to Vmin that is equivalent to or lower than Vsus (V). By applying the voltage Vmax (V) that is equivalent to or higher than Vsus (V) to the sustain voltage quickly at a time of 0<T<Tr1 (s), a discharge similar to a trigger discharge occurs, thereby increasing a plasma concentration in terms of electrons and ions.

Then, the sustain voltage is set to Vmin (V) that is equivalent to or lower than Vsus (V) at a time T=2Tr1 (s) to lower an electric field in the discharge cell at the discharge current peak time at which the plasma concentration reaches to the maximum. Owing to the presence of a remarkably large number of electrons each having a low kinetic energy, Xe atoms are efficiently brought into an excitation state wherein the ultraviolet lights are emitted. Thus, the electrons effectively bring Xe atoms into the excitation state wherein the ultraviolet light are emitted to increase an excitation and dissipation efficiency of the electrons, thereby realizing an improvement in the ultraviolet emission efficiency.

FIG. 3 shows a comparison between a discharge and emission characteristics of a plasma display panel according to a control method of applying voltage of the present invention and a discharge and that according to a conventional control method of applying a rectangular waveform.

As shown in the new applied voltage (A) of FIG. 3, a brightness, a joule consumption of energy and an ultraviolet emission efficiency when setting Tr1 to 10 ns, Vmax to 300 V and Vmin to 120 V as a control method of applying voltage of the present embodiment are compared with those of a conventional control method of applying rectangular waveform. As is apparent from FIG. 3, the control method of applying voltage of the present invention is improved in the ultraviolet emission efficiency with the brightness being increased and the joule consumption being decreased compared with the conventional method.

Thus, the composite voltage waveform that is formed by overlapping a conventional rectangular waveform applied repeatedly with the voltage applied from the circuit for generating variation waveform in high frequency 110 is applied to the Y electrodes and the X electrodes that are the sustain discharge electrodes. The rapid first rise and fall time Tr1 (s), the maximum voltage Vmax (v) and the minimum voltage Vmin (V) are so controlled that the discharge current peak position is set at the second rise period 2Tr1<T<Tr (s), thereby increasing the excitation and dissipation efficiency of the electrons that contribute to an emission of ultraviolet lights to achieve an effect of improving the ultraviolet emission efficiency.

Embodiment 2

Figure 4A:
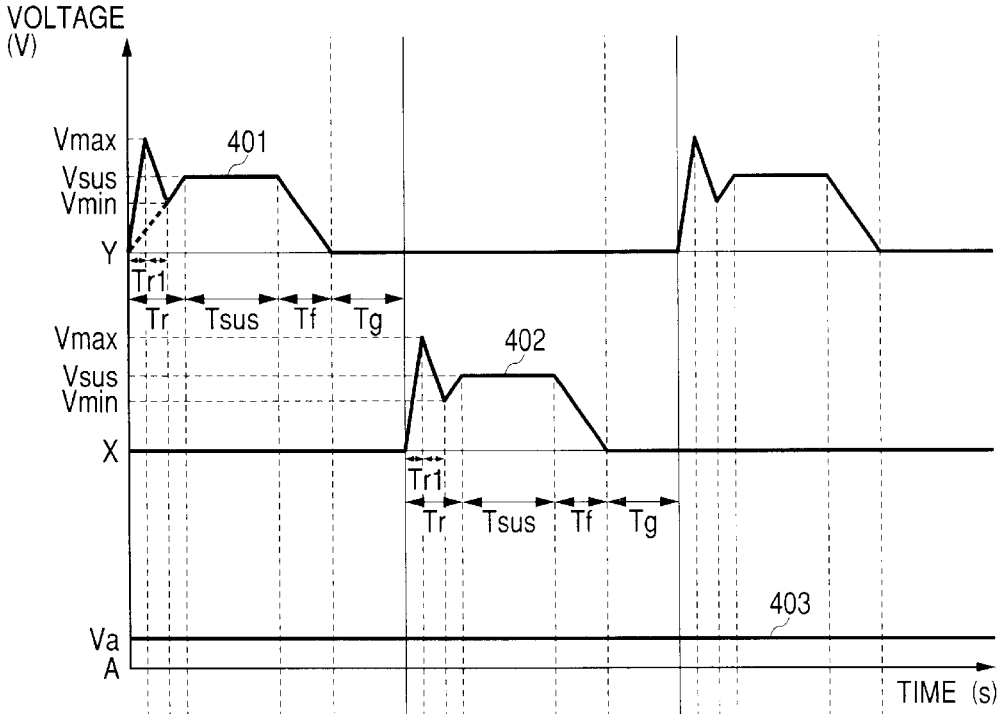
FIGS. 4(A) and 4(B) show an applied voltage sequence and a discharge current waveform of the plasma display panel of the plasma display device according to a second embodiment of the present invention.
Figure 4B:
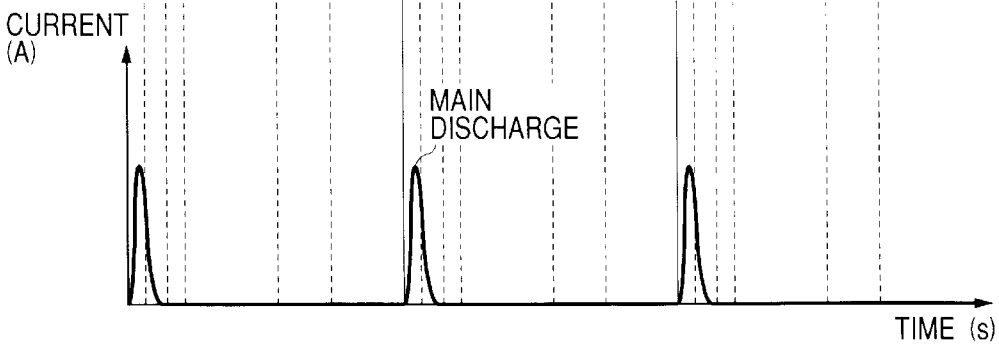

FIG. 4(A) shows a voltage sequence of a PDP of a plasma display device according to the second embodiment of the present invention. FIG. 4(B) shows a discharge current waveform.

Shown in FIG. 4(A) is voltage waveforms of the sustain discharge voltages applied simultaneously between the X electrodes and the Y electrodes during the sustain discharge period 1211 shown in FIG. 12(A). A composite voltage waveform is applied to the Y electrodes and the X electrodes that are sustain discharge electrodes in such a manner that a voltage applied from a circuit for generating variation waveform in high frequency 110 is overlapped with a conventional rectangular waveform that is applied repeatedly. The composite voltage waveform forms a voltage waveform 401 at a side of the Y electrodes and forms a voltage waveform 402 at a side of the X electrodes.

When the head of each of the composite voltage waveforms is a time 0, each of the composite voltages has a waveform that reaches to a maximum voltage Vmax (V) by a first rise at a time 0<T<Tr1 (s), followed by reaching to a minimum voltage Vmin (V) by a first fall at a time Tr1<T<2Tr1 (s) and then leads to a rise of the conventional rectangular waveform at a time 2Tr1<T<Tr (s).

A constant voltage value Vsus (V) is applied at a time Tr<T<Tr+Tsus (s), followed by lowering the voltage to 0V by a second fall at a time Tr+Tsus<T<Tr+Tf+Tsus (s), and then the voltage 0V is maintained at a time Tr+Tf+Tsus<T<Tr+Tf+Tsus+Tg (s). The composite voltage waveform is applied alternately to the Y electrodes and the X electrodes. A constant voltage Va is applied to the A electrodes in the same manner as the conventional art to form an applied voltage waveform 403.

A discharge current waveform in the sustain discharge period is shown in FIG. 4(B). A peak time of a main discharge current is set at a time 0<T<Tr (s) in the first rise period by setting a time Tr1 to about 100 ns, followed by increasing a sustain voltage at a time T=Tr1 to Vmax (V) that is equivalent to or higher than Vsus (V), and then decreasing a sustain voltage at a time T=2Tr1 to Vmin that is equivalent to or lower than Vsus (V). The main discharge occurs by applying the voltage Vmax (V) that is equivalent to or higher than Vsus to the sustain voltage at the time 0<T<Tr1 (s), thereby increasing a plasma concentration in terms of electrons and ions.

Since a degree of movement of electrons is higher than that of ions, the electrons reach to the surface of dielectric rapidly to decrease the electron concentration. When the electrons reach at the surface of dielectric, a wall charge is formed to weaken an electric field of a discharge cell, thereby making it difficult to increase the plasma concentration by electric discharge. In the present invention, the applied voltage is increased after the main discharge to increase the electric field of the discharge cell. Therefore, the plasma concentration is further increased to make it possible to increase the electron concentration. Thus, an electron injection efficiency that is a rate of joule consumption of electrons among the whole joule consumption of electrons and ions is maintained at a relatively high level, thereby making it possible to improve the ultraviolet emission efficiency.

As shown in the new applied voltage (B) of FIG. 3, a brightness, a joule consumption of energy and an ultraviolet emission efficiency when setting Tr1 to 100 ns, Vmax to 300 V and Vmin to 120 V as a control method of applying voltage of the present embodiment are compared with those of a conventional control method of applying voltage. As is apparent from FIG. 3, the control method of applying voltage of the present invention is improved in the ultraviolet emission efficiency with the brightness and the joule consumption being increased compared with the conventional method.

Thus, the composite voltage waveform that is formed by overlapping a conventional rectangular waveform applied repeatedly with the voltage applied from the circuit for generating variation waveform in high frequency 110 is applied to the Y electrodes and the X electrodes that are the sustain discharge electrodes. The first rise and fall time Tr1 (s) and the maximum voltage Vmax (v) are so controlled that the discharge current peak position is set at the first rise period 0<T<Tr1 (s), thereby increasing the electron injection efficiency among the whole joule consumption that contributes to an emission of the ultraviolet lights to achieve an effect of improving the ultraviolet emission efficiency.

Embodiment 3

Figure 5:
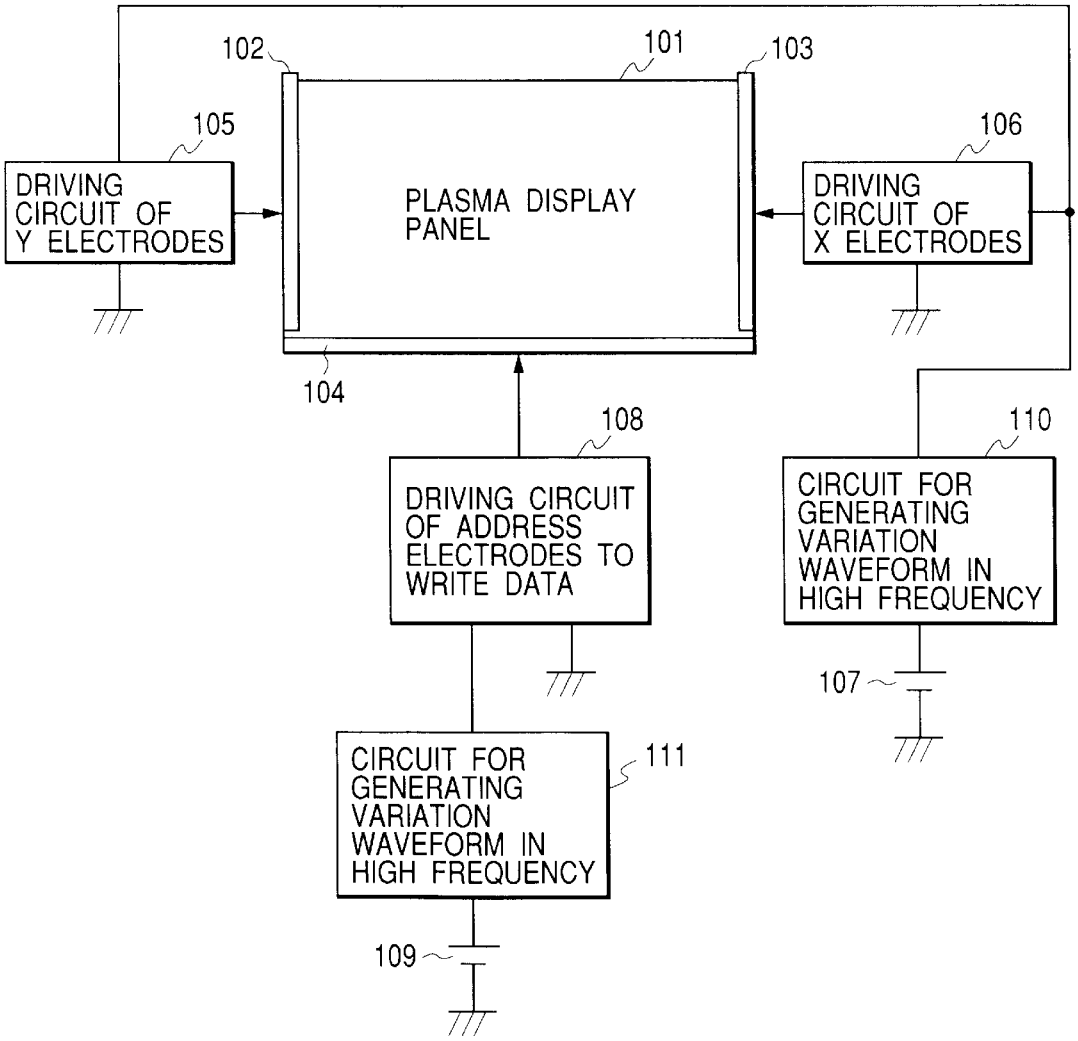
FIG. 5 is a schematic block diagram showing a plasma display device according to a third embodiment of the present invention.

FIG. 5 is a schematic block diagram showing a plasma display device according to the third embodiment of the present invention.

As shown in FIG. 5, the plasma display device of the present embodiment comprises a PDP 101, an electrode terminal of Y 102, an electrode terminal of X 103, an electrode terminal of A 104, a driving circuit of Y electrodes 105 for driving the electrode terminal of Y, a driving circuit of X electrodes 106 for driving the electrode terminal of X, a power source 107 for applying a voltage to the driving circuits of Y and X, a driving circuit of A electrodes 108, a power source 109 for applying a voltage to the driving circuit of A, a circuit for generating variation waveform in high frequency 110 that is connected in series with the power source for supplying voltages and electric power to the driving circuits of Y and X, and a circuit for generating variation waveform in high frequency 111 that is connected in series with the power source for applying a voltage to the driving circuit of A.

Figure 6A:
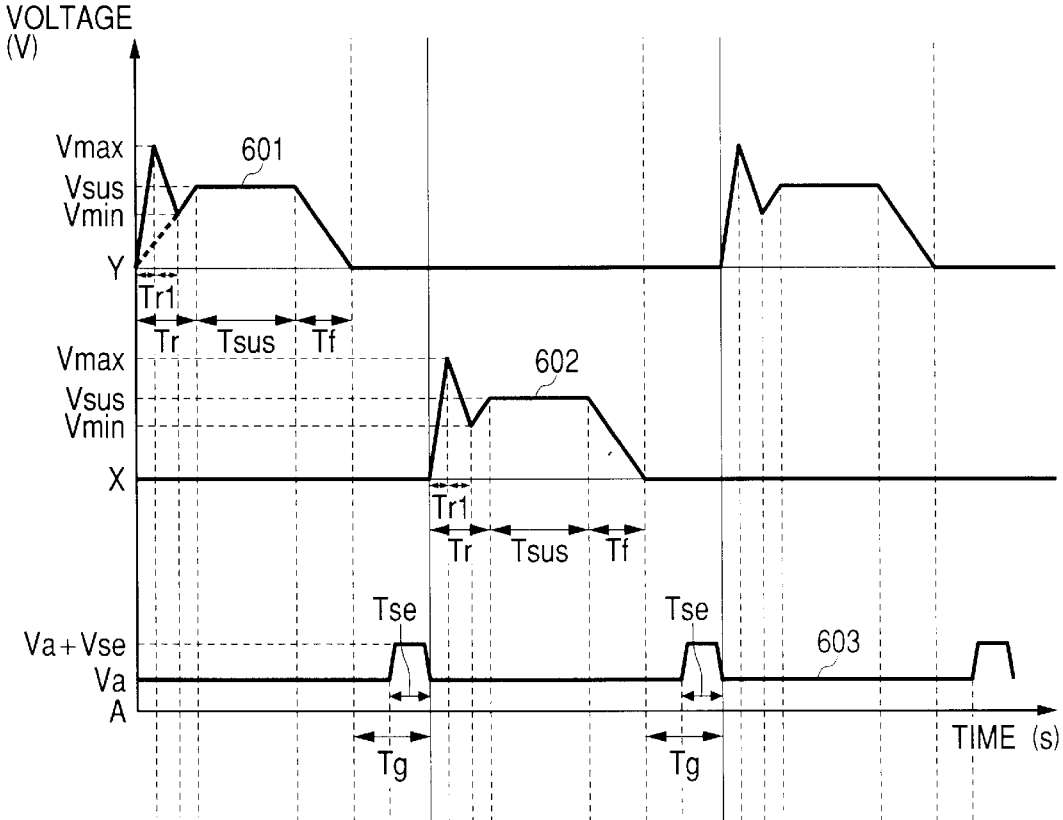
FIGS. 6(A) and 6(B) show an applied voltage sequence and a discharge current waveform (Tr=10 ns) of the plasma display panel of the plasma display device according to the third embodiment of the present invention.
Figure 6B:
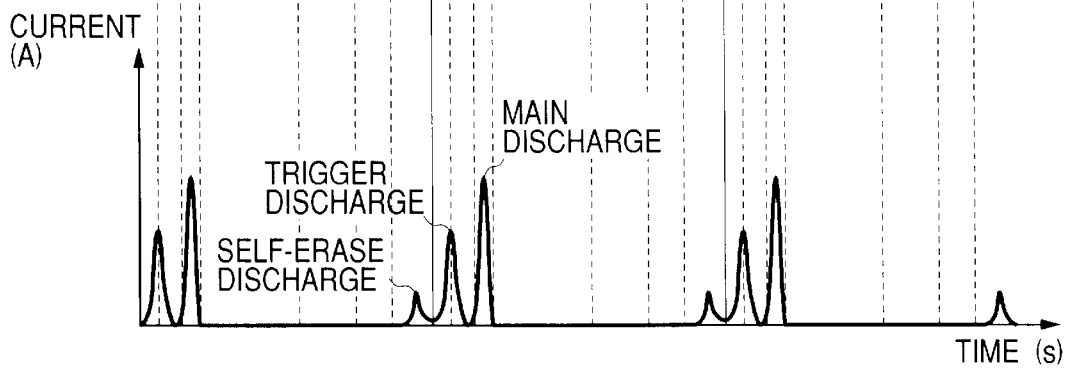

FIG. 6(A) shows an applied voltage sequence of the PDP of the plasma display device according to the third embodiment of the present invention. FIG. 6(B) shows a discharge current waveform.

FIG. 6(A) shows voltage waveforms of sustain discharge voltages applied simultaneously between the X electrodes and Y electrodes during the sustain discharge period 1211 shown in FIG. 12(A). A composite voltage waveform is applied to the Y electrodes and the X electrodes that are sustain discharge electrodes in such a manner that an applied voltage from a circuit for generating variation waveform in high frequency 110 is overlapped with a conventional rectangular waveform that is applied repeatedly. The composite voltage waveform forms a voltage waveform 601 at a side of the Y electrodes and forms a voltage waveform 602 at a side of the X electrodes.

When the head of each of the composite voltage waveforms is a time 0, each of the composite voltages has a waveform that reaches to a maximum voltage Vmax (V) by a first rise at a time 0<T<Tr1 (s), followed by reaching to a minimum voltage Vmin (V) by a first fall at a time Tr1 <T<2Tr1 (s), and then leads to a rise of the conventional rectangular waveform at a time 2Tr1<T<Tr (s).

A constant voltage value Vsus (V) is applied at a time Tr<T<Tr+Tsus (s), followed by lowering the voltage to 0V by a second fall at a time Tr+Tsus<T<Tr+Tf+Tsus (s), and then the voltage 0V is maintained at a time Tr+Tf+Tsus<T<Tr+Tf+Tsus+Tg (s). The composite voltage waveform is applied alternately to the Y electrodes and the X electrodes.

In turn, an applied voltage waveform of the A electrode forms a waveform 603. A constant voltage Va is applied to the A electrodes during a time 0<T<Tr+Tf+Tsus (s). During a partial period of a time Tr+Tf+Tsus<T<Tr+Tf+Tsus+Tg (s), a voltage of Va+Vse (V) is applied from the circuit for generating variation waveform in high frequency 111 to the A electrodes.

A discharge current waveform in the sustain discharge period is shown in FIG. 6(B). In a partial period of the time Tr+Tf+Tsus+T<Tr+Tf+Tsus+Tg (s), the voltage of Va+Vse (V) is applied from the circuit for generating variation waveform in high frequency 111 to the A electrodes, and a potential difference equivalent to or larger than the starting voltage is caused between a side of the Y electrodes or the X electrodes of the front dielectric to which a minus wall charge adheres and the A electrodes, thereby generating a discharge. The discharge is sometimes referred to as "self-erase discharge", since the discharge is generated from not a potential difference caused by a voltage applied from outside but a potential difference caused by its wall charge and the wall charge by the generated discharge is erased.

The voltage Va+Vse (V) to be applied to the A electrodes is adjusted and a time period for applying the voltage is adjusted to be a part of a time Tr+Tf+Tsus<T<Tr+Tf+Tsus+Tg (s), so that the self-erase discharge current is controlled to be overlapped with a main discharge with respect to a voltage to be applied subsequently.

A main discharge is generated at a time of a low voltage in the rectangular first rise period with the service of electrons and ionic charges left in a discharge cell region. Owing to the presence of a remarkably large number of electrons having a low kinetic energy, the main discharge is generated in a state where an electric field of the discharge cell is relatively low, thereby bringing Xe atoms effectively into an excitation state where the electrons emit ultraviolet lights. Thus, an excitation and dissipation efficiency of electrons is increased to effectively bring Xe atoms into the excitation state where the electrons emit ultraviolet light, thereby making it possible to improve an ultraviolet emission efficiency.

As shown in the new applied voltage waveform (C) of FIG. 3, a brightness, a joule consumption of energy and an ultraviolet emission efficiency when setting an A electrode of Va+30 (V) to be in a time Tr+Tf+Tsus+200 ns<T<Tr+Tf+Tsus+Tg and setting Tr1 to 10 ns, Vmax to 300 V and Vmin to 120 V as a control method of applying voltage of the present embodiment are compared with those of a conventional control method of applying voltage. As is apparent from the figure, the control method of applying voltage of the present invention is improved in the ultraviolet emission efficiency with the brightness and the joule consumption being increased compared with the conventional method.

Figure 7A:
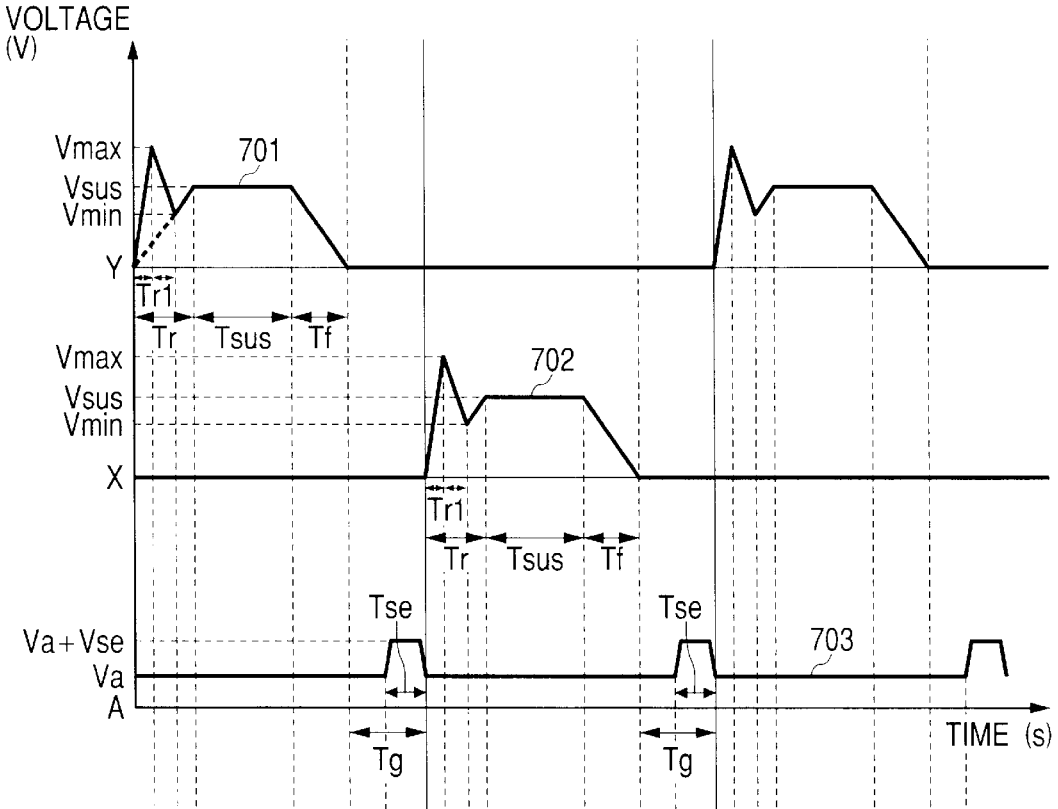
FIGS. 7(A) and 7(B) shows an applied voltage sequence and a discharge current waveform (Tr=10 ns) of the plasma display panel of the plasma display device according to the third embodiment of the present invention.
Figure 7B:
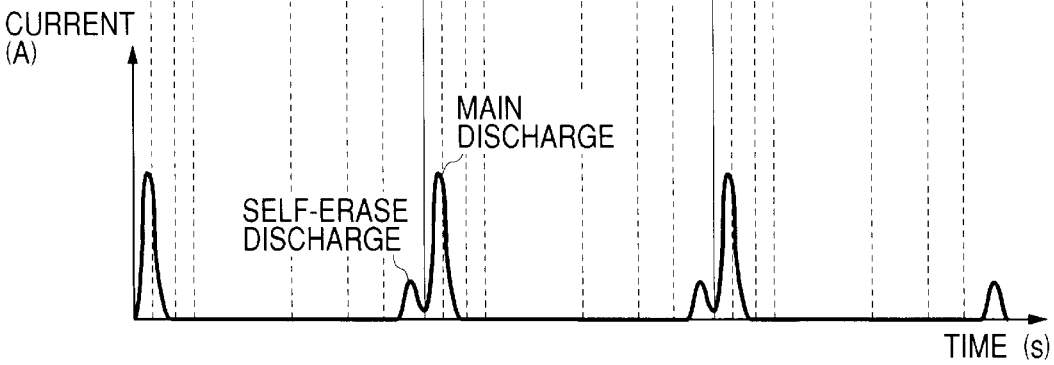

FIG. 7(A) shows voltage waveforms of sustain discharge voltages applied simultaneously between the X electrodes and Y electrodes during the sustain discharge period 1211 shown in FIG. 12(A). As shown in the new applied voltage waveform (D) of FIG. 3, a brightness, a joule consumption of energy and an ultraviolet emission efficiency when setting an A electrode of Va+30 to be in a time of Tr+Tf+Tsus+200 ns <T<Tr+Tf+Tsus+Tg and setting Tr1 to 100 ns, Vmax to 300 V and Vmin to 120 V as a control method of applying voltage of the present embodiment are compared with those of a conventional control method of applying voltage. As is apparent from FIG. 3, the control method of applying voltage of the present invention is improved in the ultraviolet emission efficiency with the brightness and the joule consumption being increased compared with the conventional method.

Thus, according to the present embodiment, the composite voltage waveform that is formed by overlapping a conventional rectangular waveform applied repeatedly with the voltage applied from the circuit for generating variation waveform in high frequency 110 is applied to the Y electrodes and the X electrodes that are the sustain discharge electrodes. The self-erase voltage is applied to the A electrodes from the circuit for generating variation waveform in high frequency 111. Thus, the self-erase voltage applying period Tr+Tf+Tsus<T<Tr+Tf+Tsus+Tg (s) and the self-erase voltage Va+Vse (V) are controlled and the self-erase discharge current and the main discharge current are overlapped with each other. Thus improve the excitation and dissipation efficiency of electrons that contributes to an emission of the ultraviolet lights is improved, thereby achieving an effect of improving the ultraviolet emission efficiency.

Embodiment 4

Figure 8:
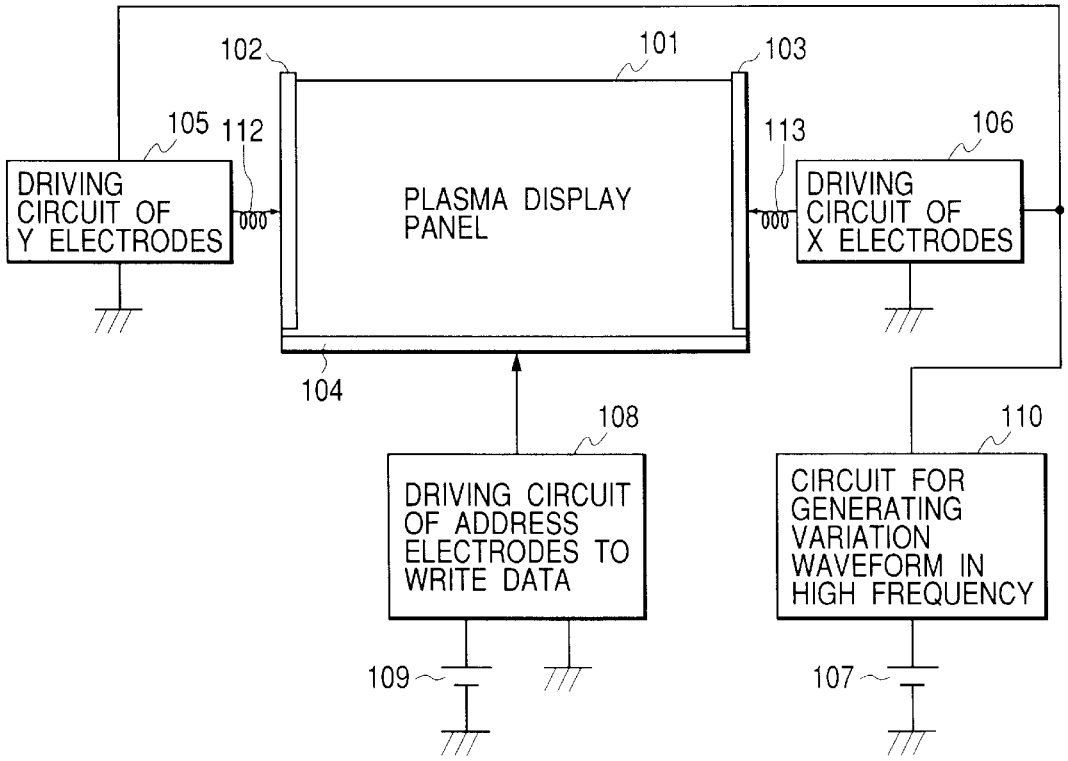
FIG. 8 is a schematic block diagram showing a plasma display device according to a fourth embodiment of the present invention.

FIG. 8 is a schematic block diagram showing a plasma display device according to the fourth embodiment of the present invention.

As shown in FIG. 8, the plasma display device of the present embodiment comprises a PDP 101, an electrode terminal of Y 102, an electrode terminal of X 103, an electrode terminal of A 104, a driving circuit of Y electrodes 105 for driving the electrode terminal of Y, a driving circuit of X electrodes 106 for driving the electrode terminal X, a power source 107 for applying voltages to the driving circuits Y and X, a driving circuit of A 108, a power source 109 for applying voltages to the driving circuit of A 108, a circuit for generating variation waveform in high frequency 110 that is connected in series with the power source for supplying voltages and electric power to the driving circuits of Y and X electrodes, and inductance circuits (for example, a coil) 112 and 113 that are connected in series with the power source for supplying voltages and electric power to the driving circuits of Y and X electrodes.

Figure 9A:
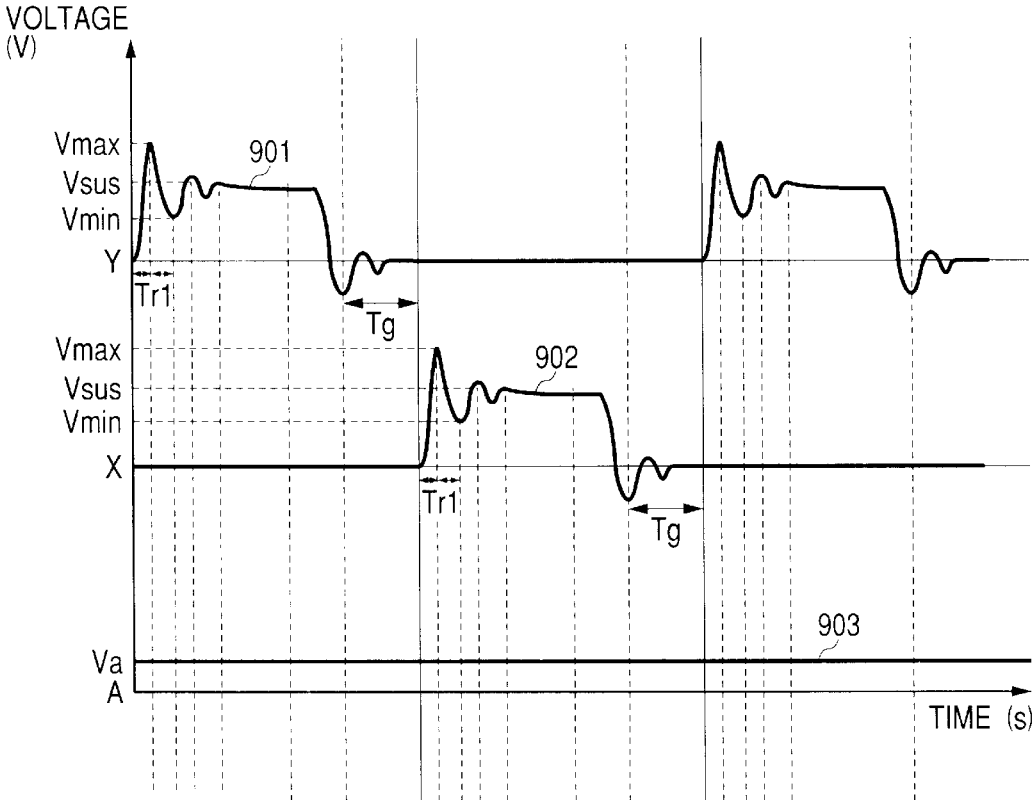
FIGS. 9(A) and 9(B) show an applied voltage sequence and a discharge current waveform of the plasma display panel of the plasma display device according to the fourth embodiment of the present invention.
Figure 9B:
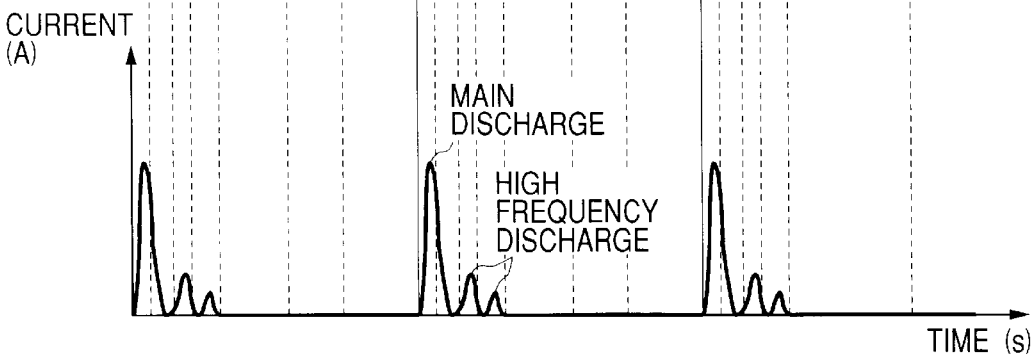
Figure 10:
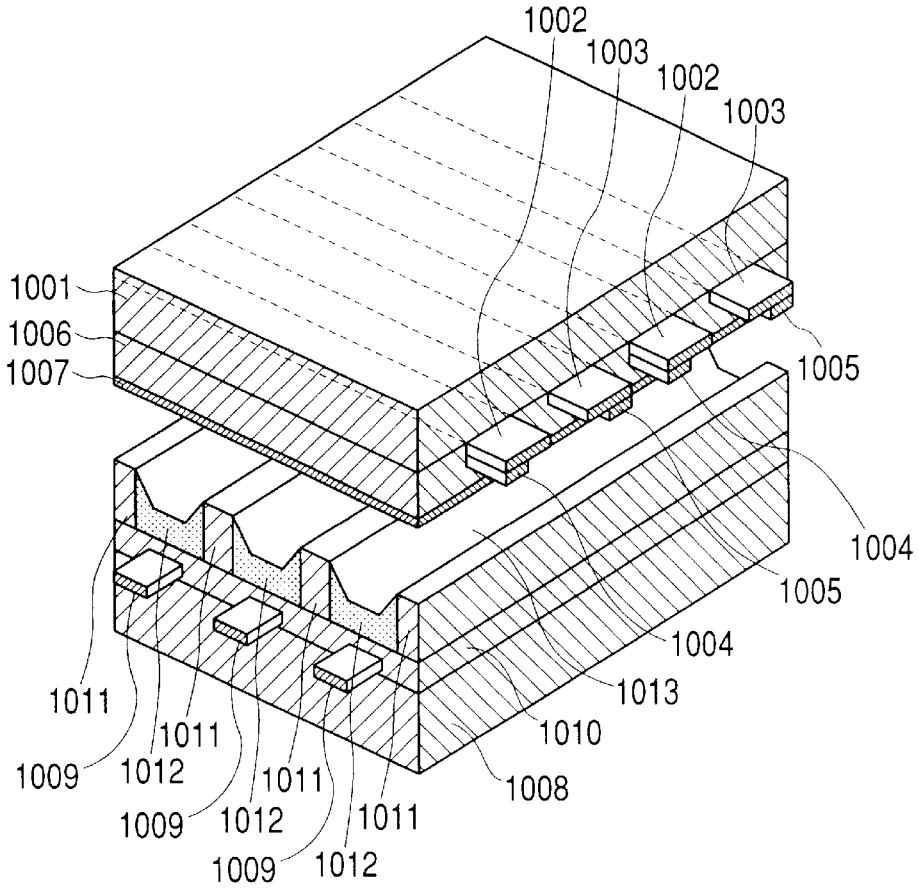
FIG. 10 is a broken perspective view of an AC planar plasma display pale with three electrodes.
Figure 11:
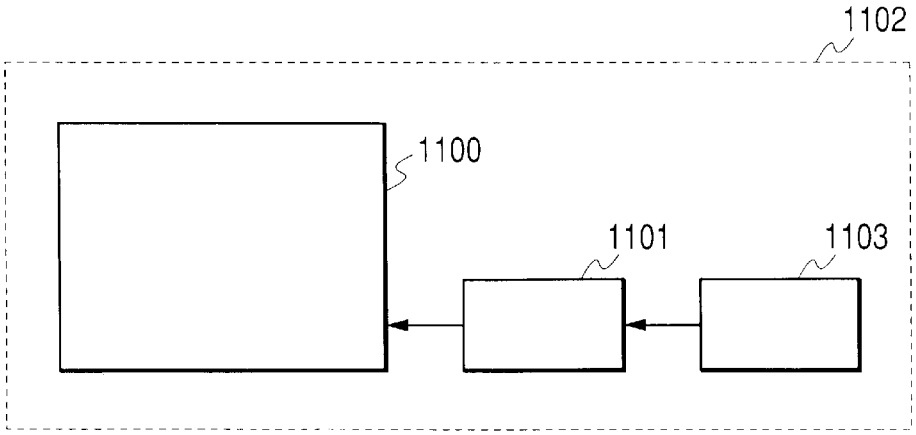
FIG. 11 is a schematic block diagram of a plasma display device.

FIG. 9(A) shows an applied voltage sequence of a PDP of the plasma display device according to the fourth embodiment of the present invention. FIG. 9(B) shows a discharge current waveform.

FIG. 9(A) shows voltage waveforms of sustain discharge voltages applied simultaneously between the X electrodes and Y electrodes during the sustain discharge period 1211 shown in FIG. 12(A). Applied to the Y electrodes and the X electrodes that are sustain discharge electrodes is a voltage waveform that is varied by an overshoot and an over-dumping generated from the circuit for generating variation waveform in high frequency 110 through the inductances in place of a conventional rectangular waveform that is applied repeatedly. The composite voltage waveform forms a voltage waveform 901 at a side of the Y electrodes and forms a voltage waveform 902 at a side of the X electrodes.

When the head of each of the composite voltage waveforms is a time 0, each of the composite voltages has a waveform that reaches to a maximum voltage Vmax (V) by a first rise at a time 0<T<Tr1 (s), followed by reaching to a minimum voltage Vmin (V) by a first fall at a time Tr1<T<2Tr1 (s), and then leads to a rise of the conventional rectangular waveform after the variation. The composite voltage waveform is applied alternately to the Y electrodes and the X electrodes. The constant voltage value Va is applied to the A electrodes in the same manner as the conventional methods and forms a voltage waveform 903.

A discharge current waveform in the sustain discharge period is shown in FIG. 9(B). A peak time of a main discharge current is positioned in a first rise voltage period of a time 0<T<Tr (s) by setting a time Tr1 to 100 ns, followed by increasing a sustain voltage at a time T=Tr1 (s) to Vmax (V) that is equivalent to or higher than Vsus (V), and then decreasing a sustain voltage at a time T=2Tr1 (s) to Vmin that is equivalent to or lower than Vsus (V). A main discharge occurs as a result of applying at a time of 0<T<Tr1 (s) the voltage Vmax (V) that is equivalent to or higher than Vsus to the sustain voltage, thereby increasing a plasma concentration in terms of electrons and ions.

Since a degree of movement of the electrons is higher than that of the ions, the electrons reach the surface of dielectric rapidly to decrease the electron concentration. When the electrons reach the surface of dielectric, a wall charge is formed to weaken an electric field of a discharge cell, thereby making it difficult to increase the plasma concentration otherwise caused by electric discharge. In the present invention, the voltage is increased even after the main discharge to increase the electric field of the discharge cell. Therefore, the plasma concentration is further increased to make it possible to increase the electron concentration. Thus, an electron injection efficiency that is a rate of joule consumption of electrons among the whole joule consumption of electrons and ions is maintained at a relatively high level, thereby making it possible to improve the ultraviolet emission efficiency.

Since the applied voltage of the present invention has a vibration type waveform wherein the overshoot and the over-dumping is repeated as shown FIG. 9(B), a discharge current corresponding to the high frequency is repeatedly generated. In this field, a spatial electric field of the discharge cell is lowered due to the adhesion of the wall charge. Owing to the presence of a remarkably large number of electrons each having a low kinetic energy, Xe atoms are efficiently brought into an excitation state wherein the ultraviolet lights are emitted. Thus, the electrons effectively bring Xe atoms into the excitation state wherein Xe atoms emits the ultraviolet lights, thereby increasing an excitation and dissipation efficiency of the electrons to make it possible to improve an ultraviolet emission efficiency.

As shown in the new applied voltage waveform (E) of FIG. 3, a brightness, a joule consumption of energy and an ultraviolet emission efficiency when setting L to 10 $\mu$H, Tr1 to 100 ns, Vmax to 300 V and Vmin to 120 V as a control method of applying voltage of the present embodiment are compared with those of a conventional control method of applying voltage. As is apparent from FIG. 3, the control method of applying voltage of the present invention is improved in the ultraviolet emission efficiency with the brightness and the joule consumption being increased compared with the conventional method.

According to the present embodiment, applied to the Y electrodes and the X electrodes that are sustain discharge electrodes is the composite voltage waveform that is formed by overlapping through the inductances the conventional rectangular waveform that is applied repeatedly with the voltage applied from the circuit for generating variation waveform in high frequency 110. The inductances or the first rise and fall time Tr1 (s) and the maximum voltage Vmax (V) is/are so controlled as to set the discharge current peak position at the first rise period 0<T<Tr1 (s), thereby increasing an injection efficiency of the electrons that contributes to an emission of the ultraviolet lights and achieving an improvement in the ultraviolet emission efficiency.

As described above, the control method of applying voltage of the present invention realizes the electric field state that is effective for improving the ultraviolet emission efficiency by varying the voltages to be applied to the sustain electrodes and the address electrodes as well as suitably controlling the transition of the electric field in the discharge cell during the discharge, thereby realizing a plasma display device that suppresses a consumption of electric power and is improved in the emission brightness.

What is claimed is:

1. A control method of applying voltage on plasma display device comprising:

structuring a discharge cell between a pair of a first electrode and a second electrode arranged in parallel to each other on a front panel and an address electrode to write data provided on a back panel;

applying a sustain discharge voltage to each of the first and the second electrode; and causing a discharge emission in the discharge cell to display an image;

wherein a discharge peak time of the discharge current is controlled by setting a voltage applied to the first and the second electrode during a sustain discharge period to be a composite voltage which is a sum of the sustain discharge voltage and a variation voltage having a voltage higher than the sustain discharge voltage.

2. The control method of applying voltage on plasma display device according to claim 1, comprising setting the voltage applied to the address electrode during the sustain discharge period to be a constant voltage.

3. The control method of applying voltage on plasma display device according to claim 2, comprising setting the voltage applied to the address electrode during the sustain discharge period to be a voltage that is a sum of the constant voltage and a variation voltage.

4. The control method of applying voltage on plasma display device according to claim 1, wherein the composite voltage is a voltage having a waveform composed of an overshoot that is higher than the sustain discharge voltage and an over-dumping that is lower than the sustain discharge voltage.

5. A plasma display device comprising:

a plasma display panel provided with a plurality of discharge cells in the form of a matrix each having a pair of a first electrode and a second electrode that are arranged in parallel to each other on a front panel and an address electrode to write data arranged on a back panel;

a first driving circuit for applying a sustain discharge voltage to the first electrode;

a second driving circuit for applying a sustain discharge voltage to the second electrode;

a driving circuit to write data for applying a voltage to the address electrode; and a first circuit for generating variation waveform in high frequency for adding a variation voltage to the sustain discharge voltage that is connected to each of the first and second driving circuits;

wherein a composite voltage which is a sum of the sustain discharge voltage and the variation voltage is applied to each of the first and second electrodes.

6. The plasma display device according to claim 5, comprising setting a voltage applied to the address electrode by the driving circuit to write data to be a constant voltage.

7. The plasma display device according to claim 6, comprising a second circuit for generating variation waveform in high frequency that is connected to the driving circuit to write data and adds a variation voltage to the constant voltage to be applied to the address electrodes.

8. The plasma display device according to claim 5, comprising an inductance circuit for setting the composite voltage to be a voltage having a waveform composed of an overshoot that is higher than the sustain discharge voltage and an over-dumping that is lower than the sustain discharge voltage.

9. A control method of applying voltage on plasma display device, comprising a plasma display panel having a plurality of discharge cells each having a pair of sustain discharge electrodes, and an address electrode to write data for applying a voltage to at least one of the sustain discharge electrodes and the address electrode during a sustain discharge period, said control method comprising the steps of:

applying a sustain discharge voltage of a voltage waveform composed of a rise period (Tr) from a first voltage level to a second voltage level, a sustain period (Tsus) for maintaining the second voltage level, a fall period (Tf) from the second voltage level to the first voltage level, and a sustain period (Tg) for maintaining the first voltage level;

applying a constant voltage to the address electrode; and applying to at least one of the pair of sustain discharge electrodes a composite voltage which is a sum of the sustain discharge voltage and a variation voltage during the rise period.

10. The control method of applying voltage on plasma display device according to claim 9, wherein a main discharge peak time of a discharge current is controlled by setting the composite voltage, during the rise period, to be a voltage larger than the sustain discharge voltage as well as by changing a time period during which the voltage larger than the sustain discharge voltage is generated.

11. The control method of applying voltage on plasma display device according to claim 9, comprising applying the sum of the voltage and the variation voltage to the address electrode during a period where the time (T) is Tr+Tf+Tsus<T<Tr+Tf+Tsus+Tg.

12. The control method of applying voltage on plasma display device according to claim 9, comprising setting the composite voltage to be a voltage waveform composed of an overshoot and an over-dumping by means of the inductance circuit, wherein the overshoot has a voltage that is higher than the sustain discharge voltage during the rise period and the over-dumping has a voltage lower than the sustain discharge voltage.

* * * * *